US010625890B2

(12) United States Patent
Vollenkemper et al.

(10) Patent No.: US 10,625,890 B2
(45) Date of Patent: Apr. 21, 2020

(54) DEVICE AND METHOD FOR FILLING OPEN BAGS

(71) Applicant: HAVER & BOECKER OHG, Oelde (DE)

(72) Inventors: Willi Vollenkemper, Oelde (DE); Volker Schutte, Oelde (DE); Martin Schwakenberg, Warendorf (DE)

(73) Assignee: HAVER & BOECKER OHG, Oelde (DE)

( * ) Notice: Subject to any disclaimer, the term of this patent is extended or adjusted under 35 U.S.C. 154(b) by 261 days.

(21) Appl. No.: 15/509,043

(22) PCT Filed: Sep. 24, 2015

(86) PCT No.: PCT/EP2015/071942

§ 371 (c)(1),
(2) Date: Mar. 6, 2017

(87) PCT Pub. No.: WO2016/046302

PCT Pub. Date: Mar. 31, 2016

(65) Prior Publication Data

US 2017/0275032 A1 Sep. 28, 2017

(30) Foreign Application Priority Data

Sep. 24, 2014 (DE) ..... 10 2014 113 859

(51) Int. Cl.
*B65B 1/00* (2006.01)
*B65B 43/26* (2006.01)
(Continued)

(52) U.S. Cl.
CPC ..... *B65B 43/26* (2013.01); *B65B 1/02* (2013.01); *B65B 1/22* (2013.01); *B65B 1/26* (2013.01);
(Continued)

(58) Field of Classification Search
CPC ..... B65B 1/26; B65B 43/30; B65B 43/62; B65B 67/12
See application file for complete search history.

(56) References Cited

U.S. PATENT DOCUMENTS 2,071,504 A * 2/1937 Darling ..... B65B 43/62 141/234
2,281,516 A * 4/1942 Royal ..... B65B 43/30 493/313
(Continued)

FOREIGN PATENT DOCUMENTS

DE 1179853 B 10/1964
DE 2516089 A1 10/1975
(Continued)

*Primary Examiner* — Andrew M Tecco
*Assistant Examiner* — Eyamindae C Jallow
(74) *Attorney, Agent, or Firm* — Pearne & Gordon LLP

(57) ABSTRACT

Apparatus and method for filling bulk goods into empty open bags (3) comprising at least one weighing unit (7) and at least one filling station (11-18) and a bag receiving unit (10) disposed thereat, wherein a bag (3) received by the bag receiving unit (10) is filled. The bag receiving unit (10) is configured as a receiving box (30) having a receiving space (31) to receive a bag (3). The receiving box (30) is provided with a suction aperture (34) to temporarily receive in the receiving box (30) the empty bag (3) intended for receiving in a form-fit at least in sections. The receiving box (30) comprises suction apertures (34) in a lower region (31*a*) and in at least one region (31*b*, 31*c*) above that which are controlled differently.

19 Claims, 4 Drawing Sheets

Figure 1:
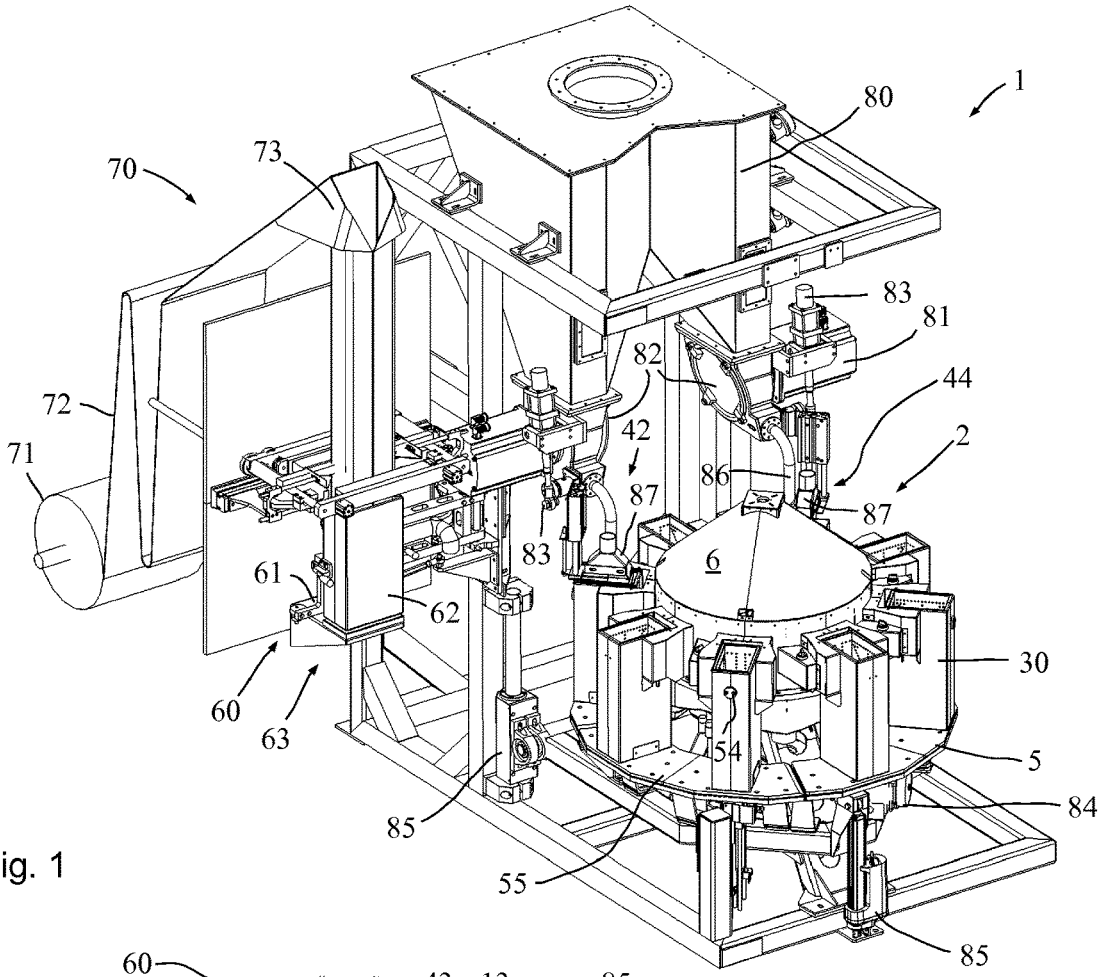

(51) Int. Cl.

| | |
|---|---|
| ***B65B 43/14*** | (2006.01) |
| ***B65B 43/50*** | (2006.01) |
| ***B65B 59/00*** | (2006.01) |
| ***B65B 1/02*** | (2006.01) |
| ***B65B 1/22*** | (2006.01) |
| ***B65B 1/26*** | (2006.01) |
| ***B65B 1/28*** | (2006.01) |
| ***B65B 1/46*** | (2006.01) |
| ***B65B 39/12*** | (2006.01) |

(52) U.S. Cl.
CPC ..... *B65B 1/28* (2013.01); *B65B 1/46* (2013.01); *B65B 39/12* (2013.01); *B65B 43/14* (2013.01); *B65B 43/50* (2013.01); *B65B 59/005* (2013.01)

(56) References Cited

U.S. PATENT DOCUMENTS 2,418,142 A 4/1947 Socke
2,932,142 A * 4/1960 Sindzinski ..... B65B 67/12 53/386.1
3,527,021 A 9/1970 Pitts et al.
3,903,674 A 9/1975 Brush et al.
4,586,320 A * 5/1986 Takai ..... B65B 31/022 53/374.8
4,662,409 A * 5/1987 Egli ..... B65B 1/32 141/1
4,696,357 A * 9/1987 Beehler ..... G01G 13/295 177/145
4,723,392 A * 2/1988 Takeda ..... B65B 31/022 53/434
5,119,615 A * 6/1992 Kujubu ..... B65B 57/04 53/53
5,380,957 A * 1/1995 Giles ..... G01F 1/80 177/16
5,940,926 A * 8/1999 Inzinna ..... B08B 15/002 15/301
6,474,372 B2 * 11/2002 Sanderson ..... B65B 1/32 141/104
2016/0001909 A1 1/2016 Schutte et al.

FOREIGN PATENT DOCUMENTS

DE 102007002381 A1 5/2008
DE 102013003223 A1 8/2014
EP 0844179 A1 5/1998
EP 0844180 A1 5/1998

* cited by examiner

DEVICE AND METHOD FOR FILLING OPEN BAGS

The present invention relates to an apparatus and a method for filling empty open bags which are also referred to as open-mouth bags. The invention in particular also relates to an apparatus and a method for filling empty open-mouth bags with dry bulk goods or liquids, wherein the filling weight of a filled open-mouth bag is between approximately 1 kg and 10 kg. Higher and lower filled weights are also conceivable.

Bags which are filled with bulk materials such as cement, high-quality tile grout, or other construction materials and having the comparatively low weights indicated may also be called pouches or small sacks.

These bags tend to be manufactured immediately prior to filling in a device installed upstream of the apparatus. To this end for example a flat sheet is pulled over a shaping shoulder where the flat sheet is welded together to obtain a tubular film. Bottom seams are inserted at regular intervals and the bulk material intended for filling is filled into the tube so partitioned until the desired weight or volume is reached. Then the top seam is made and the bag is detached.

These manufacturing processes function reliably. The bags manufactured and filled in this way are used on the market in large quantities. However, it is desirable to obtain, optionally or as required, better sealing of the filled bulk material. This is difficult with the manufacturing method described.

It is therefore the object of the present invention to provide an apparatus and a method enabling more flexibility with bagging and in particular allowing to reliably fill open-mouth bags or pouches manufactured in some other way.

This object is solved by an apparatus having the features of claim 1 and by a method having the features of claim 16. Preferred specific embodiments of the invention are the subjects of the subclaims. Further advantages and features of the present invention can be taken from the general description and the description of the exemplary embodiment.

An apparatus according to the invention serves to fill empty open-mouth bags in particular with bulk goods or fluids. The apparatus comprises at least one filling station and a bag receiving unit disposed thereat. At least one weighing unit is provided. A bag received by the bag receiving unit is at least partially filled. At least one bag receiving unit is configured as a receiving box having a receiving space to temporarily receive a bag. The receiving box is provided with at least one suction aperture to receive in the receiving box the empty bag intended for taking up in a form-fit at least in sections. The receiving box comprises suction apertures in a lower region and in at least one region above that which are controlled separately.

The bag is in particular received in the receiving box in a form-fit at least at its lower end. Preferably the receiving box is configured and set up to suck in the empty bag intended for taking up through the at least one suction aperture.

The apparatus according to the invention has many advantages. A considerable advantage of the apparatus according to the invention consists in that an as yet empty open-mouth bag intended for filling is handed over to a bag receiving unit which receives it in a form-fit. This both facilitates handling and also provides the option to compact the filled open-mouth bag prior to closing the filled bag for example by a top weld seam.

The bag receiving unit configured as a receiving box can receive the open-mouth bag in the receiving space in a form-fit so as to allow trouble-free filling.

Form-fit presently means that both the bag bottom and also the sidewalls of the open-mouth bag rest against the boundaries of the receiving space and thus the bag is opened for the following filling process and in particular retained open during the following filling.

In preferred specific embodiments the apparatus is provided with multiple filling stations wherein each of the filling stations is provided with a bag receiving unit. The apparatus may in particular comprise a rotary filling carousel having multiple filling stations. The filling carousel preferably rotates in increments or indexed in operation. The apparatus is particularly preferably suitable and set up to fill bulk goods into empty open-mouth bags.

It is possible and preferred for the bag to be opened at and in particular in the receiving box during handover of an empty open-mouth bag intended for filling. It is also possible to feed a pre-opened open-mouth bag to the receiving box for example from above. Due to the suction through the suction apertures of the receiving box the pre-opened empty bag is then reliably transported into the receiving space where it rests form-fittingly at least in sections.

In particularly preferred configurations the receiving box is configured tubular and comprises at least one open top end. Through this open top end an empty open-mouth bag intended for filling is supplied to the receiving box.

Particularly preferably the receiving box also has an open bottom end. The receiving box comprises an in particular continuous free cross-section which the filled open-mouth bag will later show. This configuration provides for retaining the open-mouth bag intended for filling in the receiving box by way of the suction through the suction apertures. When the suction is deactivated the open-mouth bag falls downwardly due to gravity out of the bottom end of the receiving box, if sufficient space is available.

In preferred specific embodiments the receiving box comprises a plurality of suction apertures at least at one inner wall adjacent to the receiving space so that the bag wall rests snug against the receiving space, retaining the top open. When the open bag intended for receiving is still located above the receiving box, suctioning the receiving space may generate a local vacuum causing the open bag intended for receiving to be sucked into the receiving box.

In advantageous specific embodiments the receiving box is configured with a double wall at least on one side and particularly preferably at least on two sides opposite one another and comprises at least one intermediate space so that at least in the intermediate space at least one air chamber is provided for vacuum distribution. It is thus sufficient to provide only one or a small number of suction connections at the receiving box while the vacuum or the generated negative pressure dissipates through the air chamber to the plurality of suction apertures. The receiving box is in particular configured with a circumferential double wall. The intermediate space may be sectioned in the vertical direction to configure a bottom air chamber and at least one air chamber disposed above which may be subjected to a vacuum separately or together. The air chambers may be sectioned e.g. by webs.

In advantageous configurations the receiving box comprises at least one suction branch. The at least one air chamber may be supplied with vacuum through the suction branch. It is also possible to provide the receiving box with two or more separate air chambers or suction apertures which can be suctioned separately from one another so as to enable a suctioning profile or a time sequence of suction processes through different suction apertures.

In particularly preferred configurations the receiving box has suction apertures in a bottom region and in at least one region above. At least two, three or more of these regions are provided to be controlled differently.

In preferred specific embodiments the receiving box is exchangeably fastened to a retaining device. The retaining device is in particular assigned to and firmly connected with the filling station. Exchanging a receiving box allows to process bags of different dimensions. Other than different heights of the receiving spaces, different cross-sectional surfaces can be enabled to allow flexibility in filling different weights.

In particularly preferred configurations a separate bottom plate is provided at and/or inserted in a bottom end of each of the receiving boxes. This bottom plate is disposed movable relative to the receiving box at least in the vertical direction. Preferably the bottom plate is supported on a base platform of the apparatus. The base platform may for example serve to transmit vibrations to the bottom plate and thus to the open bag intended for filling to cause deaeration and compacting of the filled material. The bottom plate is in particular configured separately and for traveling along. The bottom plate comprises in particular at least one suction aperture. The suction aperture may be provided with a supporting grate and/or at least one wire mesh or other air-permeable supporting means for supporting the sack or bag bottom.

In all the configurations it is preferred for the retaining device to comprise at least one retaining arm and in particular a pair of retaining arms and for at least one suction duct to be assigned to or provided at the retaining device. The retaining arms serve to retain the receiving box. The receiving box is suctioned off or supplied with a vacuum through the suction duct. It is also possible for two or more separate suction ducts at the retaining device to be in functional connection with the receiving box. The suction duct of the retaining device may protrude into a suction branch of the receiving box or vice versa. It is also possible for a suction branch of the receiving box to terminate by a narrow or very narrow gap in front of the suction duct. Escaping air if any may be compensated. Sealing is possible.

Preferably at least two opposite inner walls of the receiving box diverge conically upwardly. This facilitates inserting a bag from above and also removing the bag upwardly. A preferred angle is between 0.2° and 5° and preferably between 0.25° and 2°.

All the configurations preferably provide for a plurality of filling stations with a bag receiving unit positioned at each of the filling stations. Particularly preferably the retaining devices are disposed in a star-shaped arrangement at a filling carousel and a deaeration duct is provided for connection with the bag receiving units.

Particularly preferably a handover station for transferring open bags intended for filling is provided. An as yet empty open bag intended for filling is transferred to a bag receiving unit at the handover station. The handover station preferably comprises a swivel arm to which a receiving box is attached that is in particular exchangeable. The receiving box of the handover station is disposed at the filling station on a plane immediately above the upper edge of the receiving box. This allows the handover station to accept from a bag source an open bag intended for filling in one swivel position and to hand over the bag to the bag receiving unit at the filling station in another swivel position. The receiving box of the handover station is disposed in the other swivel position immediately flush above the receiving box of the filling station. This means that after activating the suction apertures at the receiving box of the filling station and after deactivating the suction apertures at the receiving box of the handover station the still empty open bag is sucked downwardly from above into the receiving box of the filling station where it comes to rest in a form-fit against the receiving space. This enables a particularly simple and efficient handover of empty open bags intended for filling to the apparatus and at the same time to its aperture.

The apparatus serves to fill in particular bulk goods into open bags by the gross weighing method. The open bag is weighed including the already filled bulk material for controlling the filling process.

The method according to the invention serves to fill in particular bulk goods into empty open bags by means of an apparatus comprising at least one weighing unit, at least one filling station, and a bag receiving unit disposed at the filling station. The bag received at the bag receiving unit is at least partially filled. An empty bag intended for receiving is temporarily received at the receiving box in form-fit at least in sections through suction apertures at the bag receiving unit that is configured as a receiving box. Suctioning is preferably carried out at different intensities and/or at different times in a lower region of the receiving box and in at least one region above.

The method according to the invention also has many advantages since it allows a simple and efficient handover of an empty open bag intended for filling and subsequent filling of the same.

Air is preferably sucked off through suction apertures provided in the inner walls of the receiving box so that the wall of an empty bag intended for filling rests against the interior of the receiving box at least in sections and possibly entirely in a form-fit.

It is possible and preferred that as an empty open bag is received, sucking off or applying a vacuum through suction apertures is firstly stronger in a lower region of the receiving box than in a region lying above. For example for taking over an open bag intended for filling, only suction apertures in a lower region of the receiving box may be sucked off first while the suction apertures in a mid or top region of the receiving box do not suck off any air. However, since there is suction in a lower region of the receiving box, a downwardly air flow is generated in the receiving box overall and thus a vacuum resulting in sucking in the open bag intended for filling. It is also possible to suction off air through the suction apertures both in a lower region and also in an upper region. Suction may be stronger in the lower region than in the upper region.

According to another configuration of the method, suction will first be stronger in an upper region than in a lower region of the receiving box as an empty open bag is received. As receiving or takeover of an empty open bag begins, the vacuum is first increased in an upper region of the receiving region so as to accelerate handover of the open bag intended for filling. The suction can then virtually follow what is the current state or the level of the bottom of the open bag intended for takeover, so that as handover of the open bag intended for filling progresses, the downwardly suction increases, while it decreases in an upper region at least temporarily to prevent the bag wall from adhering.

In another configuration, sucking off through the suction apertures is first provided in a mid or upper region and thereafter in a lower region of the receiving box when an empty open bag is received.

Further advantages and features of the present invention can be taken from the exemplary embodiment which will be described below with reference to the enclosed figures.

Figure 2:
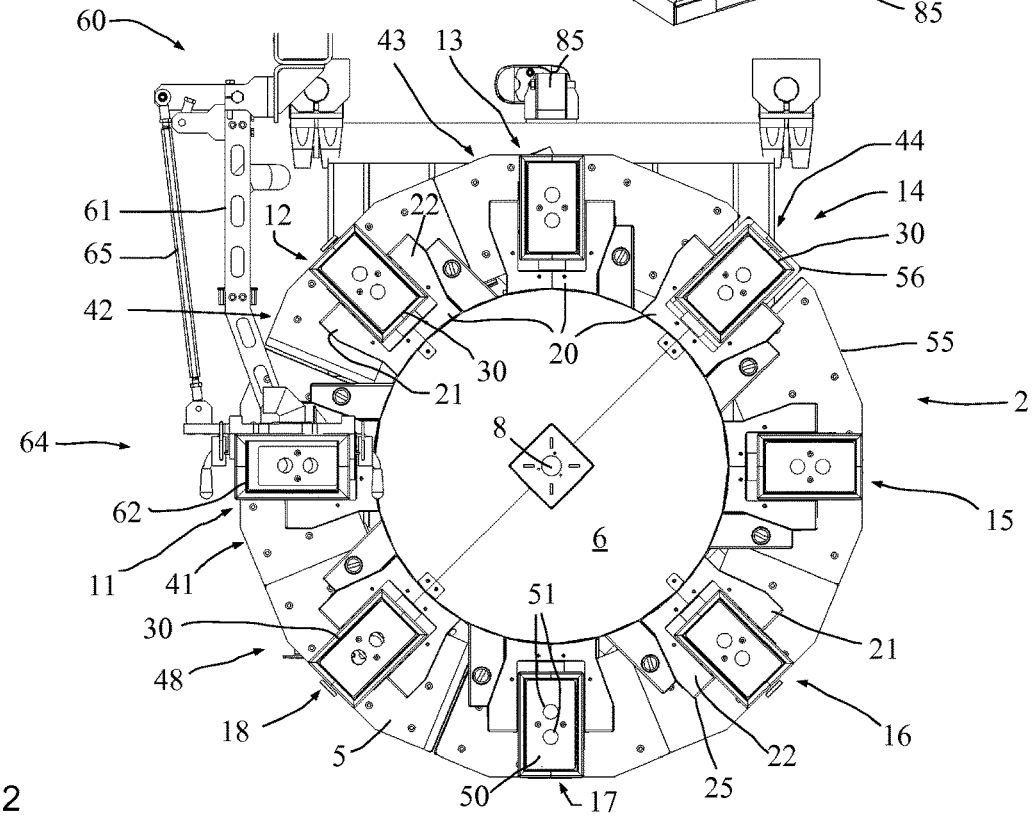
Figure 3:
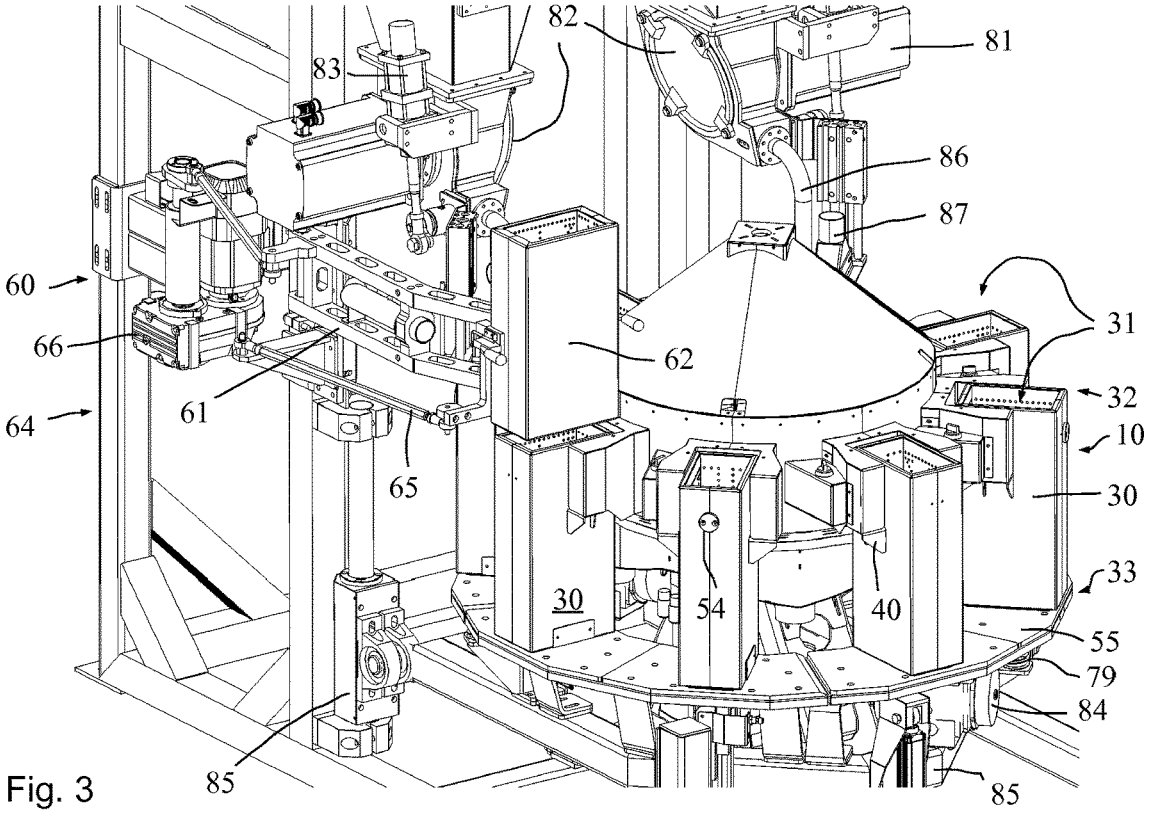
Figure 4:
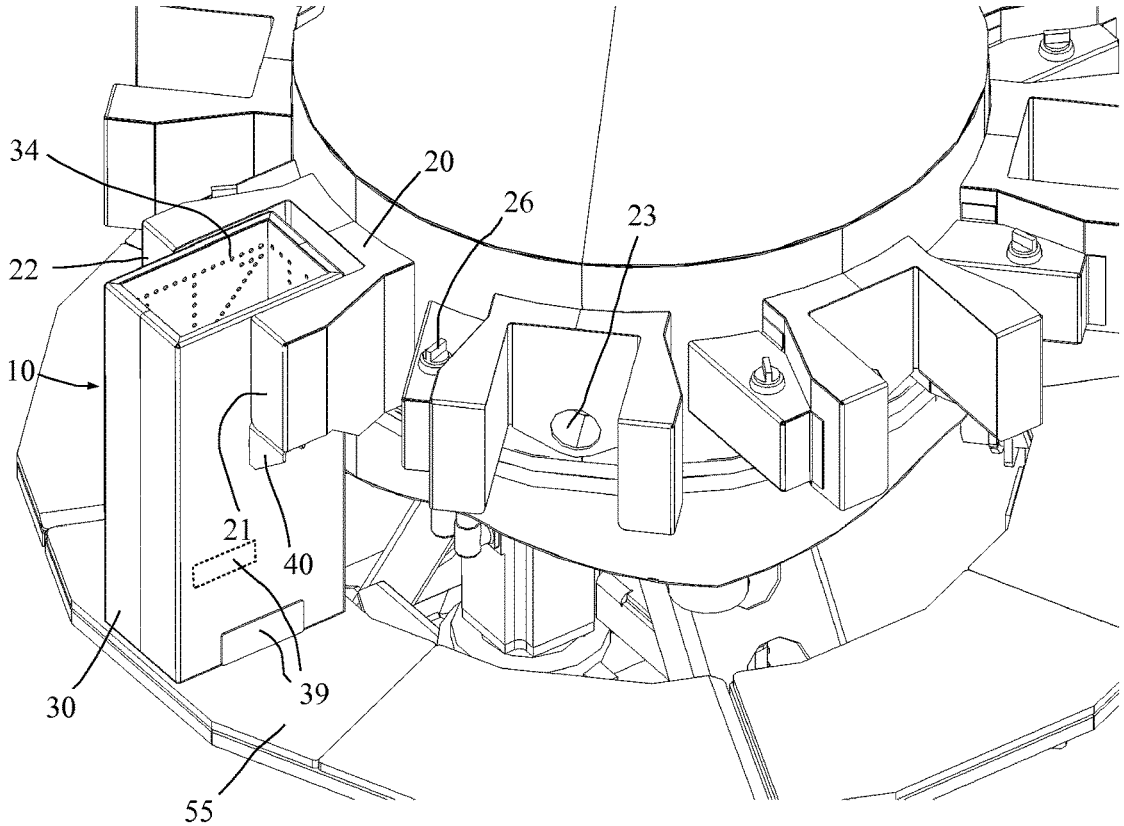
Figure 5:
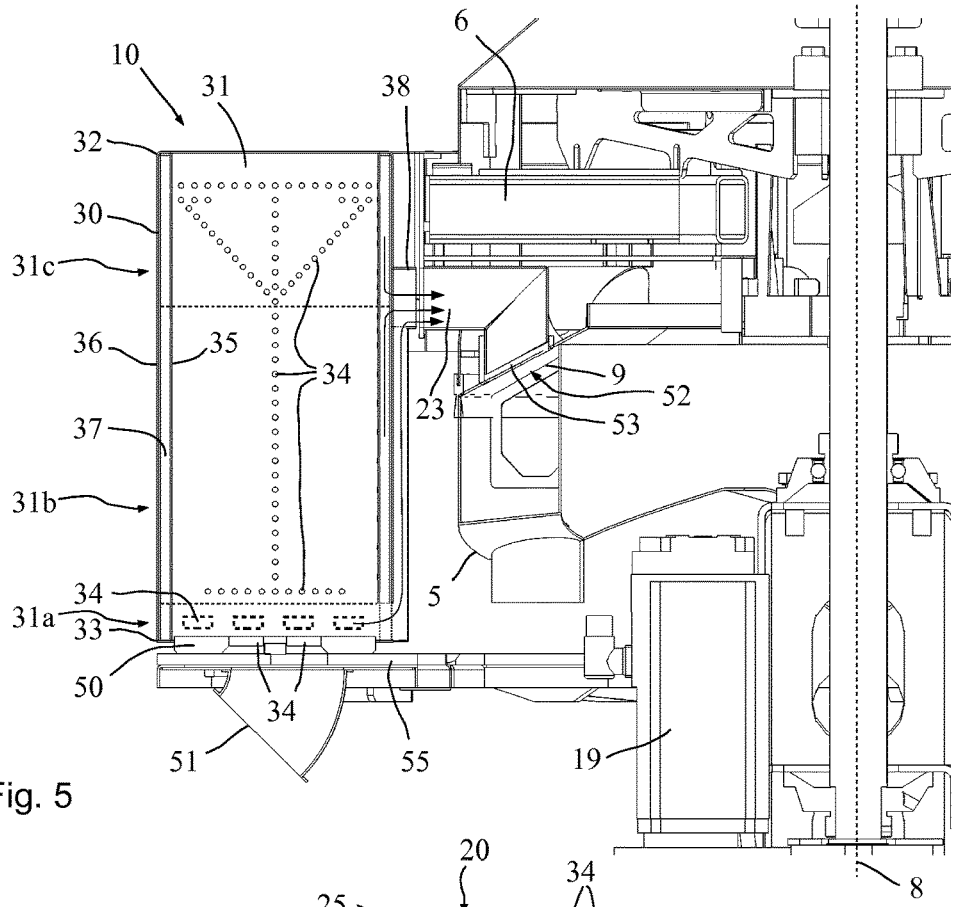
Figure 6:
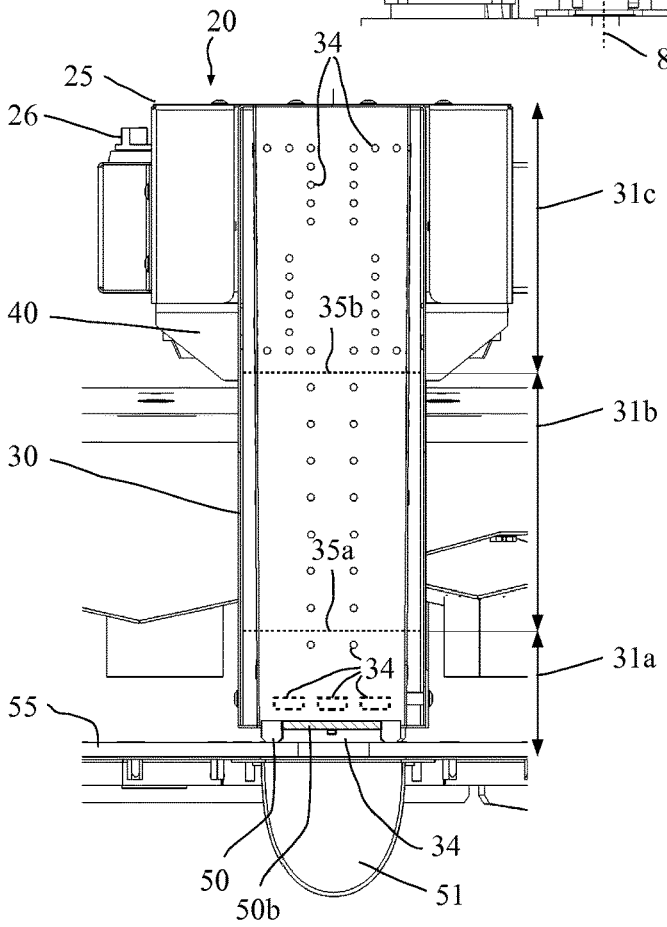
Figure 7:
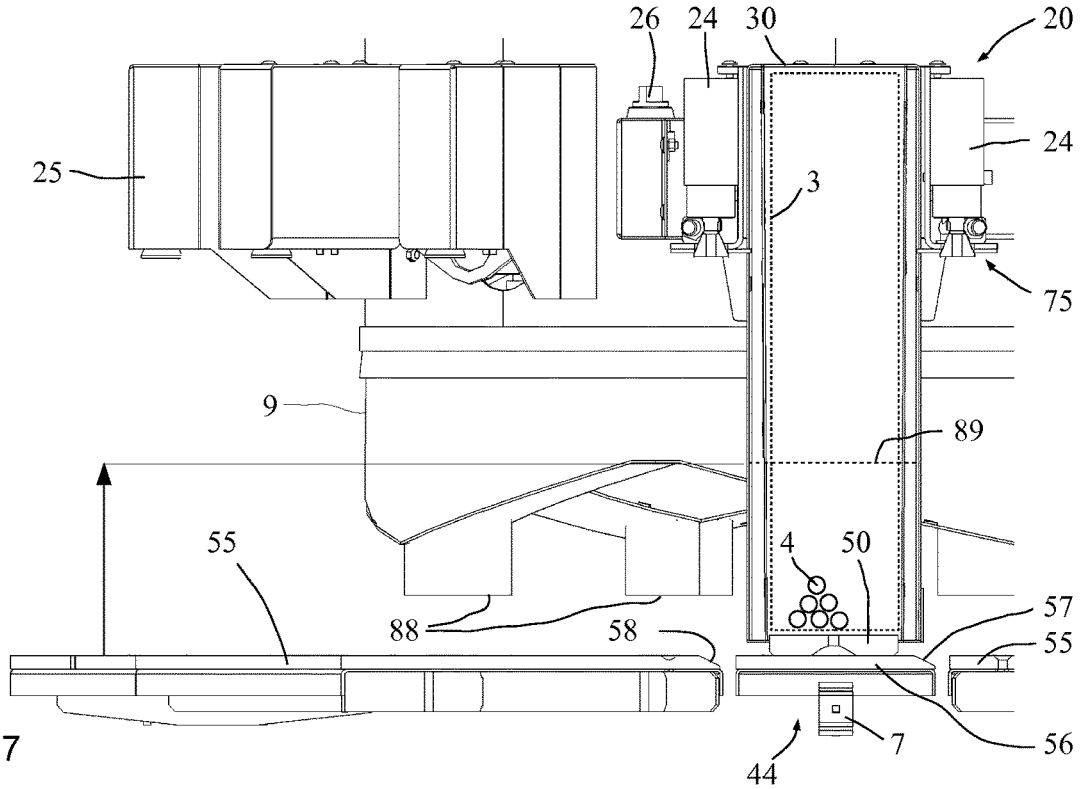
Figure 8:
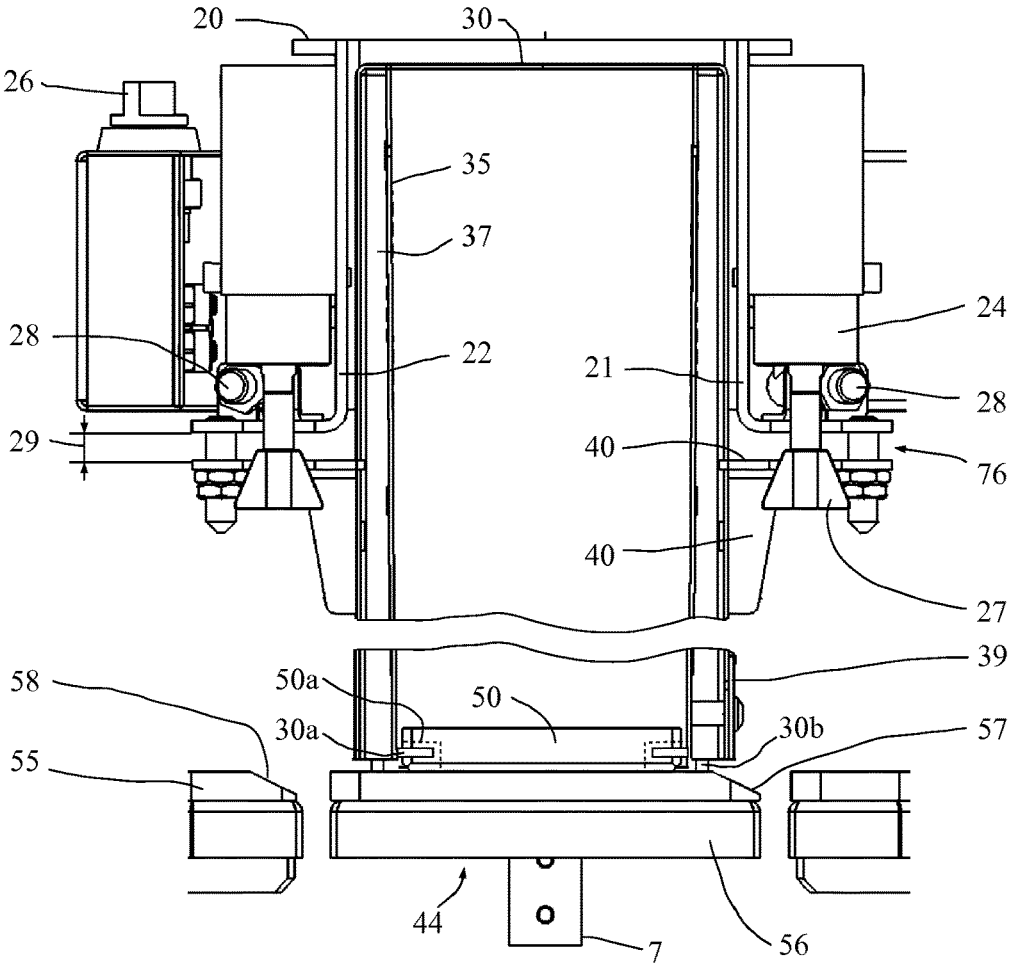

The figures show in:

FIG. 1 a perspective view of an apparatus according to the invention;

FIG. 2 a sectional top view of the apparatus according to FIG. 1;

FIG. 3 an enlarged perspective view of the apparatus according to FIG. 1;

FIG. 4 a still more enlarged perspective detail view of the apparatus according to FIG. 1;

FIG. 5 a horizontal section of the apparatus according to FIG. 1;

FIG. 6 an enlarged cross-section;

FIG. 7 a horizontal view of a detail of the view according to FIG. 1; and FIG. 8 an enlarged illustration of the bag receiving unit in the decoupling position.

With reference to the FIGS. 1 and 2 the basic structure of an apparatus 1 according to the invention that is configured as a filling machine 1 will now be described. FIG. 1 shows a perspective total view of an apparatus 1 for filling bulk goods and fluids into flexible open-top bags 3. The bags 3 processed at the apparatus 1 illustrated in FIG. 1 consist of a flexible material and in particular of plastic material. The apparatus comprises a filling carousel 2, a bag source 70 and an intermediate silo 80 for intermediate storing of the bulk goods.

In this exemplary embodiment the bag source 70 is provided with a film roll 71 on which a sheet of film 72 is wound. The sheet of film 72 unwound from the film roll 71 is fed to a shaping shoulder 73. There the sheet of film 72 consisting of a plastic film is guided around the shoulder and a longitudinal seam is welded so as to create a continuous tubular film.

The bag bottom is manufactured at the handover station 60 by making suitable welding seams transverse to the longitudinal extension of the tubular film. The tubular film having a suitable cross-section is conveyed and taken into the receiving box 62 of the handover station 60. The open-mouth bag 3 intended for filling is form-fittingly received there. For supplying, the tubular film is cut to size so as to manufacture the open top end of the open-mouth bag 3.

It is also possible to manufacture the open-top bags from a prefabricated, e.g. extruded tubular film or else to feed completely prefabricated, flexible bags or sacks from a magazine or the like.

FIG. 1 illustrates the swivel position 63 of the handover station 60 while FIG. 2 illustrates the swivel position 64 at which the open-mouth bag 3 intended for filling is transferred to the handling station 41 acting as the takeover station where the open-mouth bag 3 intended for filling is handed over to the filling station 12 as is illustrated in FIG. 2.

As can be seen in the FIGS. 1 and 2, the apparatus 1 comprises a basic frame to which the filling carousel 2 and the further components are attached. The stationary part 5 of the apparatus 1 comprises a base platform 55. The base platform 55 extends beneath the path of motion of the bag receiving units 30 disposed at the filling stations 11 to 18.

Each of the filling stations 11 to 18 has a retaining device 20 fastened to the movable part 6. Each retaining device 20 in turn carries a bag receiving unit 10 which receives, retains, and guides the bags intended for filling.

This filling carousel 2 is provided for indexed operation so that the filling stations 11 to 18 and the bag receiving units 10 received thereon are successively transported to the individual handling stations 41 to 48.

The takeover station being the handling station 41 takes over an open-mouth bag 3 intended for filling by means of a bag receiving unit 10. FIG. 2 shows the takeover of the open-mouth bag 3 intended for filling by means of the bag receiving unit 10 at the filling station 11. The filling carousel 2 is provided for indexed operation so that following a cycle the open-mouth bag 3 taken over last is located at the handling station 42 which is provided for high speed flow filling.

As can be seen in FIG. 1, the handling station 42 has a filling turbine 82 and a servo unit 83 and a filling pipe 86 assigned to it. The filling pipe 86 enters into a dust hood 87. During the filling process the dust hood 87 is lowered down into the bag receiving unit 10. A tubular part in the interior of the covering hood 87 extends telescope-like around the filling pipe 86 so that the filling pipe 86 is virtually extended downwardly. This reduces the height of fall of the bulk goods in the open-mouth bag intended for filling so as to reduce the quantity of dust for removal to prevent contamination of the apparatus 1. Moreover this prevents an additional permeation of the filled product with air due to an unnecessarily large height of fall. Compacting is possible at this filling station e.g. by means of a bottom vibrator already during the filling process.

After indexing the movable part 6 forward the bag intended for filling is conveyed to a compacting station 43 where the material bagged thus far is deaerated and compacted. In the next index the flexible open-mouth bag 3 reaches the handling station 44. This is where another filling turbine 82 driven by a motor 81 is located. The bulk goods intended for filling are fed in low speed flow to the open-mouth bag 3 through a filling pipe 86. Again, a covering hood 87 is provided which enters into the bag receiving unit 10 from above to reduce the height of fall of the bulk goods and thus the dust content and aeration.

Both the handling station 42 and the handling station 44 are provided with servo units 83 in the respective filling pipes 86 allowing pre-adjustment of the open cross-section of the filling pipes 86. In this way for example when filling different materials or identical materials with varying properties, the filling cross-section in high speed flow and the filling cross-section in low speed flow are preadjusted to achieve optimal filling properties.

After filling in low speed flow at the handling station 44 three further handling stations 45, 46 and 47 follow, each providing for compacting the filled material. The filled open-mouth bag is conveyed off at the handling station 48. The handling stations 45, 46 and 47 may be configured as a joint compacting station.

Each bag receiving unit 10 configured as a receiving box 30 is provided with a recognition unit 54 responsive to optical, magnetic or electronic requests and in particular returning a unique signal. In simple cases a bar code may be provided. It is preferred to use RFID (radio-frequency identification) for contactless recognition of the pertaining bag receiving unit 10. This allows to unambiguously identify and assign the bag receiving unit 10 concerned. This is significant for example when changing product or the size of the bags intended for filling to ensure attachment of the matching bag receiving units 10 to the filling carousel 2. This allows to also carry out other format-related machine settings.

Receiving boxes 30 of different heights may be provided for filling different quantities. The handling stations are oriented at the top ends of the receiving boxes 30 so as to dispose their top ends 32 (see FIG. 5) on the same level in the case of different heights of the receiving boxes 30. To carry out longitudinal compensation the height level of the base platform 55 disposed beneath is therefore displaced accordingly.

The filling carousel 2 is supported to rotate around the rotation axis 8 in its entirety. A handover of an open-mouth bag 3 intended for filling (presently) to the filling station 11 takes place at the handling station 41 in the swivel position 64 of the swivel arm 61. The swivel arm 61 with the coupling rod 65 forms a parallelogram-like swiveling device for the receiving box 62 whose basic structure is similar to the receiving boxes 30.

Each of these retaining devices 20 is provided with a pair of holder arms 21 and 22 which are covered on top by a covering hood 25 to protect from dust and contamination.

The height adjusters 85 are provided for height adjustment of the base platform 55 and the separate weigh platform 56. Individual height adjuster components may comprise a drive while other height adjuster components serve for guiding only.

Although the weigh platform 56 is mechanically decoupled from the base platform 55, it is height-adjusted concurrently with the base platform in the same way. A weighing unit 7 not visible in the FIGS. 1 and 2 is assigned to the weigh platform for measuring the weight of the weigh platform 56 and placed thereon, a receiving box 30 including an open-mouth bag 3 placed therein, and the filled bulk goods 4. Deducting the known weights of the receiving box 30, the weight of the bag material 3 and of the weigh platform 56 allows to calculate the weight of the filled bulk goods 4 by way of the gross method.

If any additional bulk goods or the like should accumulate over time on the weigh platform 56 or on individual receiving boxes 30, this may be taken into account by means of an empty run and capturing the tare weights. If the tare weight obtained by checking deviates too much from the original tare weight, a recommendation for servicing or cleaning may be emitted.

FIG. 3 shows an enlarged schematic perspective view of part of the apparatus 1, wherein details of the handover station 60 can be recognized on the left.

The swivel arm 61 and the coupling rod 65 of the handover station 60 are located in the swivel position 64, in which an open-mouth bag 3 intended for filling is handed over from the receiving box 62 to the receiving box 30 located directly underneath. The receiving box 62 and the receiving boxes 30 are provided with suction apertures 34 (see FIG. 4) through which air is sucked off so that an open-mouth bag 3 disposed in the receiving box 62 is placed form-fittingly against the inner wall of the receiving box 62.

After positioning the receiving box 62 in the swivel position 64 illustrated in FIG. 3, the suction at the receiving box 62 is deactivated and suction at the receiving box 30 acting as the receiving unit 10 is activated so that the open-mouth bag 3 is displaced downwardly out of the receiving box 62 into the receiving box 30 where the bag 3 once again comes to lie form-fittingly against the inner wall of the receiving box 30.

In FIG. 3 one can also see the dust hood 87 at the handling station 44. A dust-removing hose, not shown, is connected with the top end of the dust hood 87 to carry off the dusty air.

Each of the receiving boxes 30 comprises a receiving space 31 having a cross section, in this case rectangular, that is approximately constant over the height. Preferably the inner walls extend slightly conically diverging upwardly to facilitate insertion from above and upwardly removal. A preferred angle is between 0.25° and 2° and it may be e.g. 0.35° or 0.5°. The dimensions of the rectangular cross-section depend on the desired dimensions of the filled open-mouth bags. The dimensions are predetermined by the dimensions of the receiving boxes 30 and the flexible bag material is selected accordingly, or vice versa.

Except for the handling station 44 where the weighing unit 7 is provided, the receiving boxes 30 at the other handling stations are each located above the base platform 55.

As can be seen in FIG. 3, the handling stations 45-47 are each or in their entirety provided with at least one compacting drive 84 in the form of e.g. an unbalanced mass vibrator or a magnetic vibrator and at least one spring 79 to obtain efficient compacting of the filled material. Compacting devices acting from above are possible as well.

FIG. 4 shows a further enlargement of a perspective view of the filling carousel 2, presently with one receiving box 30 only at a retaining device 20. The suction apertures 34 can be seen in the interior of the receiving box 30. The receiving box 30 is provided with retaining link plates 40 with which the receiving box 30 is fastened to the holder arms 21 and 22 of the retaining device 20. The bottom end 33 of the receiving box 30 shows a service door 39 to provide access to the intermediate space of the double-walled receiving box 30. When multiple intermediate spaces disposed on top of one another and separated from one another are provided, a corresponding number of service doors 39 is preferably provided.

A receiving box 30 may be decoupled by means of a control device not shown in detail. Manual decoupling is possible any time by way of the unlatching device 26.

In FIG. 4 one can also recognize the suction duct 23 at the retaining device 20 through which the air is sucked out through the suction apertures 34 at the receiving box 30. Above the service door 39 shown in a solid line another service door 39 is illustrated in a broken line in the case of two intermediate spaces disposed on top of one another.

FIG. 5 shows a part sectional side view of the apparatus 1, where one can see the rotation axis 8 of the filling carousel 2 and the drive 19 of the filling carousel 2.

At the bottom end of the receiving boxes 30, bottom plates 50 lie on the base platform 55 so that a bag 3 received in the receiving box 30 is supported on the top surface of the bottom plate 50. The bottom surface of the bottom plate 50 is in gliding contact with the base platform 55 when the filling carousel 2 is indexed further.

Thus, the bottom plate 50 represents a gliding plate or wear plate that protects the bottom of an open-mouth bag 3 intended for filling from being contaminated or damaged while the filling carousel 2 is rotated or indexed further.

The receiving box 30 is shown in FIG. 5 in cross-section. It can be seen that an air chamber 37 extends from the top end 32 to the bottom end 33 between the inner wall 35 and the outer wall 36. A plurality of suction apertures 34 is disposed on the inner wall 35 for the bag wall to lie form-fittingly against the receiving space 31 of the receiving box 30.

The intermediate space 37 is supplied with a vacuum through the suction branch 38. The shown suction branch 38 ends slightly spaced apart from the suction duct 23 attached to the movable part 6. The suction duct 23 couples to the suction connection 52 at the specified fixed angular positions. A sealing connection is provided by means of the gliding sleeve 53 which glides over the outer surface of the presently annular deaeration duct 9 while the movable part 6 rotates.

The bottom plate 50 is also provided with suction apertures 34 through which air is sucked off preferably at the takeover station 41 to suck an open-mouth bag 3 intended for filling into the receiving box 30 from above or to support the movement. It is also possible to provide, instead of suction apertures 34 in the bottom plate, additional, controlled suction apertures in a bottom region of the receiving box 30.

The FIGS. 5 and 6 show in broken lines a variant where a number of regions 31*a*, 31*b* and 31*c* across the height are provided for coupled or else separately controlled suction. A lower region 31*a* is provided with additional suction apertures 34 which are shown having a rectangular cross-section. Or else these suction apertures 34 may be round, oval or slotlike or shaped otherwise. This configuration allows to omit suction apertures 34 in the bottom plates in part and in particular entirely.

For handing over an open-mouth bag 3 intended for filling to the bag receiving unit 10 or the receiving box 30, air may firstly be sucked off e.g. only in the upper region 31*c* through the suction apertures 34 in the upper region 31*c* along the drawn arrow. When the bag 3 has already been sucked some distance into the receiving box 30, suction may be activated or boosted in the mid region 31*b* while in the upper region 31*c* suction is reduced and optionally temporarily entirely deactivated. Finally, suction takes place in the lower region 34 so that a bag 3 is pulled all the way down.

It is also possible and preferred to then emit an air blast from above downwardly into the opened bag 3 which takes the bag 3 that is held open reliably and reproducibly down and positions it on the bottom plate 50 or on the base platform 55 in case no bottom plate 50 is provided. The strength of the air blast emitted through one or more air nozzles may be determined by experimenting. In the alternative or supplementarily to an air blast, a mechanical pressing device may force the bag bottom downwardly. At the same time, the suctioning action through the suction apertures 34 may be slightly reduced to ensure reliable lowering of the opened bag 3 in the bag receiving unit 10.

FIG. 6 shows a cross-section of the receiving box 30 transverse to the cross-section in FIG. 5. The receiving box 30 is retained at the retaining device 20 by means of the lateral retaining link plates 40. The manual unlatching device 26 is provided on the side. In the lower region 31*a* the bottom plate 50 rests on the base platform 55 also provided with suction apertures 34 which are coupled with the suction connection 51 beneath the bottom platform 55. The suction connection is connected with a suction hose, presently not shown.

It can be seen that a plurality of suction apertures 34 each is arranged in the lower region 31*a*, in the mid region 31*b*, and in the upper region 31*c*. The suction apertures in the different regions 31*a* to 31*c* may preferably be controlled separately if the separating webs 35*a* and 35*b* shown in broken lines are provided which then subdivide the intermediate space 31 in separate air chambers 37*a*, 37*b* and 37*c*. Controlling may be provided by separately controlled valves.

Or else it is possible to provide a specific suctioning profile across the height of the receiving box 30 by way of the number and types of suction apertures or by way of their cross-sections or by way of fixed flow cross-sections and flow paths.

FIG. 6 furthermore shows a configuration of the suction apertures 34 at the bottom plate 50 which is conceivable in all the configurations. The bottom surface of the bottom plate is formed primarily or even predominantly by an air-permeable support unit 50*b* which in this case comprises a wire cloth or multiple wire cloths. Due to the suction aperture 34 being covered by the wire cloth 50*b* the bag intended for filling can rest with its entire bottom on the bottom surface. Any bagging or deforming of the bottom due to the filled weight and/or due to suction can be largely or entirely avoided. It is also possible to use wire netting or other components to support the bottom surface. In all the cases at least one separate support member may be provided beneath the wire cloth for supporting said wire cloth as it is schematically shown in FIG. 6.

FIG. 7 shows a side view of part of the apparatus 1 with the handling station 44 visible. The handling station 44 is provided with the weighing unit 7 which can weigh the separately configured weigh platform 56 and the parts located thereon. FIG. 7 shows a state as it is present just as the handling station 44 has been reached. At this moment the receiving box 30 is still firmly coupled to the retaining device 20 through the locking unit 24 so that the receiving box 30 is not shown resting on the weigh platform 56 but located a short distance above.

Resting on the weigh platform 56 is the bottom plate 50 which is free to move in the vertical direction relative to the receiving box 30 while being configured high enough so that the receiving box 30 pulls the bottom plate 50 along in the rotational motion of the filling carousel 2. Thus, there is gliding relative motion between the bottom surface of the bottom plate 50 and the weigh platform 56 respectively the base platform 55 as the movable part 6 is indexed further. To ensure better transfer of the bottom plate 50 from the base platform 55 to the weigh platform 56 or in the next index from the weigh platform 56 to the base platform 55, the weigh platform 56 is provided with a momentum grade 57 and the base platform 55 is provided with a momentum grade 58.

A broken line in FIG. 7 shows an open-mouth bag 3 which for better clarity is shown spaced apart from the inner wall 35. The open-mouth bag 3 virtually comes to rest firmly against the inner wall 35. Some bulk goods 4 are exemplarily shown in the open-mouth bag 3.

The base platform 55 is height-adjustable and it may be adjusted high or still higher, for example up to the broken line 89, for mounting suitable receiving boxes 30 to the handling stations 41 to 48. After an exchange, bags having correspondingly smaller volumes may be filled.

FIG. 8 shows an enlarged detail view of a receiving box 30 at the weighing station 44 with the receiving box 30 shown in the lowered decoupling position 76. For decoupling, the clamping cone 27 of the locking unit 24 is extended so that the receiving box 30 previously lifted up by the retaining link plates 40 is lowered and rests on the weigh platform 56 at the weighing station 44. Extending the lifting unit respectively locking unit 24 achieves a decoupling of the weight of the receiving box 30 from the pertaining filling station respectively the pertaining retaining device 20. This allows to very accurately determine the weight thus far filled into the bag 3.

To facilitate lowering the receiving box relative to the filled bag, the connection of the suction duct 23 with the suction branch 38 may be interrupted at the weighing station to enable relative motion between the bag and the receiving box. Even if the receiving box is not lowered completely, the receiving box together with the bag rests on the weigh platform 56 by way of friction fit, which results in precise weighing by the gross method as it has been described.

For example if bulk goods intended for filling should accumulate in the intermediate space 37, the service door 39 may be opened as required to empty out and optionally clean the intermediate space 37.

FIG. 8 shows in a broken line a pair of recesses or grooves 50*a* at the bottom plate 50 which serve to receive holding units or lugs 30*a* at the receiving box 30. The components 50*a* and 30*a* ensure that the bottom plate 50 does not fall out when the receiving box 30 is lifted manually. In simple cases the holding units or lugs 30*a* at the receiving box 30 are manufactured by folding over the metal sheet edge of the receiving box 30.

The receiving box 30 may be supported on three feet 30*b* in all the configurations. At least one of the feet 30*b* may be adjustable. Preferably all of the feet 30*b* are adjustable. This prevents the receiving box 30 from resting on its outer frame as the receiving box 30 is lowered at the weigh platform 56. In the case of any manufacturing tolerances the receiving box 30 may be prevented from slightly inclining in any direction. Thus the receiving box 30 can be prevented from leaning against the holding brackets which would adulterate the weight. One, two or three adjustable feet 30*b* ensure that the receiving box 30 sits in a defined position but not on the circumferential rectangular frame. This allows optimal adjustment of every receiving box 30.

It is also possible to omit the feet 30*b* so that the receiving box 30 rests on its circumferential rectangular frame, if sufficiently narrow tolerances are ensured.

On the whole the invention provides an advantageous apparatus and an advantageous method which allow simple, efficient handover to a filling station of open-mouth bags intended for filling and which are still empty. The bottom of the open-mouth bag 3 is conveyed into the receiving box 30 due to gravitation and supported by suctioning. Due to the suction through the suction apertures 34 the bag wall comes to rest form-fittingly against the receiving box 30 so that the open-mouth bag 3 assumes an ideal, desired shape even prior to filling. This achieves efficient and material-saving filling. Moreover an optically appealing shape of the filled open-mouth bag 3 is ensured. Moreover the dust hood 87 is enabled to safely enter into the receiving box 30 and in particular even into the opened bag 3.

The receiving boxes 30 guide the open-mouth bags 3 intended for filling during transport by means of the movable part 6. To enhance weighing the receiving box 30 at the weighing station is taken to a decoupling position to determine the weight remaining to be filled and in particular to control filling the remainder into the open-mouth bag in low speed flow. A number of stations are provided where the filled material is compacted. Vibrating is possible both from beneath and from above, or else a vacuum lance or a vibrating lance or the like may enter into the opened open-mouth bag 3 to carry out efficient deaeration and thus compacting.

| List of reference numerals: | |
|---|---|
| 1 | filling machine |
| 2 | filling carousel |
| 3 | open-mouth bag |
| 4 | bulk material |

-continued

| List of reference numerals: | |
|---|---|
| 5 | stationary part |
| 6 | movable part |
| 7 | weighing unit |
| 8 | rotation axis |
| 9 | deaeration duct |
| 10 | bag receiving unit |
| 11-18 | filling station |
| 19 | drive |
| 20 | retaining device |
| 21-22 | holder arm |
| 23 | suction duct |
| 24 | locking unit |
| 25 | covering hood |
| 26 | unlatching device |
| 27 | clamping cone |
| 28 | detector |
| 29 | lift |
| 30 | receiving box |
| 30a | lug |
| 30b | foot |
| 31 | receiving space |
| 31a | lower region |
| 31b | mid region |
| 31c | upper region |
| 32 | top end |
| 33 | bottom end |
| 34 | suction aperture |
| 35 | inner wall |
| 35a | separating web |
| 35b | separating web |
| 36 | outer wall |
| 37 | air chamber |
| 37a | air chamber |
| 37b | air chamber |
| 37c | air chamber |
| 38 | suction branch |
| 39 | service door |
| 40 | retaining link plate |
| 41-48 | handling station |
| 50 | bottom plate |
| 50a | groove |
| 50b | wire cloth |
| 51-52 | suction connection |
| 53 | gliding sleeve |
| 54 | recognition unit |
| 55 | base platform |
| 56 | weigh platform |
| 57 | momentum grade |
| 58 | momentum grade |
| 60 | handover station |
| 61 | swivel arm |
| 62 | receiving box |
| 63 | swivel position |
| 64 | swivel position |
| 65 | coupling rod |
| 66 | drive |
| 70 | bag source |
| 71 | film roll |
| 72 | sheet of film |
| 73 | shaping shoulder |
| 75 | locking position |
| 76 | decoupling position |
| 79 | spring |
| 80 | intermediate silo |
| 81 | motor for turbine |
| 82 | turbine |
| 83 | servo unit |
| 84 | compacting drive |
| 85 | height adjustment |
| 86 | filling pipe |
| 87 | dust hood |
| 88 | hose coupling |
| 89 | higher position |

The invention claimed is:

1. Apparatus for filling bulk goods into empty open bags comprising at least one filling station and a bag receiving unit disposed thereat and at least one weighing unit, wherein a pre-opened bag is transported to and received in the receiving box and wherein the bag received by the bag receiving unit is at least partially filled, characterized in that at least one bag receiving unit is configured as a receiving box having a receiving space to temporarily receive a bag at which receiving box at least one suction aperture is disposed for form-fit reception of the empty bag intended for receiving in the receiving box at least in sections, and that the receiving box comprises suction apertures in a lower region and in at least one region above, which are controlled differently, and wherein a separate bottom plate is inserted in a bottom end of each of the receiving boxes.

2. The apparatus according to claim 1, wherein the receiving box is tubular in configuration and comprises an open top end.

3. The apparatus according to claim 2, wherein the bag receiving unit comprises an open bottom end.

4. The apparatus according to claim 1, wherein the receiving box comprises a plurality of suction apertures at least at one inner wall adjacent to the receiving space so that the bag wall rests against the receiving space, the top remaining open.

5. The apparatus according to claim 1, wherein the receiving box is configured with double walls at least at one side and comprises an intermediate space so that at least in the intermediate space an air chamber for vacuum distribution is provided.

6. The apparatus according to claim 1, wherein the receiving box comprises at least one suction branch.

7. The apparatus according to claim 1, wherein the receiving box is exchangeably attached to a retaining device.

8. The apparatus according to claim 7, wherein the retaining device comprises a pair of retaining arms and at least one suction duct.

9. The apparatus according to claim 1, wherein at least one suction aperture is provided at the bottom plate.

10. The apparatus according to claim 1, wherein the bottom plates of the receiving boxes rest on a base platform.

11. The apparatus according to claim 1, wherein at least two opposite inner walls of the receiving box diverge conically upwardly.

12. The apparatus according to claim 1, wherein a plurality of filling stations and a bag receiving unit at each filling station are provided.

13. The apparatus according to claim 12, wherein retaining devices are arranged at a filling carousel in a star pattern and wherein a deaeration duct is provided to which the bag receiving units can be connected.

14. The apparatus according to claim 1, wherein a handover station with a swivel arm is provided for handing over open bags, wherein a receiving box is disposed at the swivel arm in a plane immediately above the top edge of the receiving box at the filling station, to take over in one swivel position an open bag intended for filling from a bag source and in another swivel position to hand over the bag to the bag receiving unit at the filling station.

15. Method for filling bulk goods into empty open bags having at least one weighing unit, at least one filling station and a bag receiving unit disposed at the filling station, wherein a pre-opened bag is transported to the bag receiving unit and the bag received at the bag receiving unit is at least partially filled, characterized in that through the bag receiving unit configured as a receiving box with a separate bottom plate an empty bag intended for receiving is temporarily received in the receiving box in a form-fit at least in sections, and that sucking off is provided differently at the receiving box in a lower region and in at least one region above.

16. The method according to claim 15 wherein air is sucked out of the receiving box through suction apertures provided in the inner walls so that the wall of an empty bag intended for filling comes to lie against the interior of the receiving box in a form-fit.

17. The method according to claim 15 wherein as an empty open bag is received, sucking off through suction apertures is firstly stronger in a bottom region of the receiving box than in a region above.

18. The method according to claim 15 wherein as an empty open bag is received, sucking off through suction apertures is firstly stronger in a mid or upper region and thereafter in a lower region of the receiving box.

19. The method according to claim 15, wherein as an empty open bag is received, suction apertures are sucked off in a lower region of the receiving box and in a region above.

* * * * *